United States Patent [19]

Andersen

[11] 3,968,468

[45] July 6, 1976

[54] ELECTRICAL SWITCH AND METHOD OF CALIBRATING

[75] Inventor: Edward O. Andersen, Rock Falls, Ill.

[73] Assignee: General Electric Company, Fort Wayne, Ind.

[22] Filed: June 10, 1974

[21] Appl. No.: 477,828

[52] U.S. Cl. ..... 337/107; 29/622; 337/102

[51] Int. Cl.[2] ..... H01H 61/02; H01H 63/013; H01H 65/00

[58] Field of Search ..... 29/602, 622; 339/217 R, 339/218 R; 337/99–107

[56] References Cited

UNITED STATES PATENTS

| | | | |
|---|---|---|---|
| 2,745,924 | 5/1956 | Coates | 29/622 |
| 3,243,554 | 3/1966 | Malone | 337/104 X |
| 3,846,726 | 11/1974 | Hierholzer et al. | 337/102 X |

*Primary Examiner*—J. D. Miller
*Assistant Examiner*—Fred E. Bell
*Attorney, Agent, or Firm*—Joseph E. Papin

[57] ABSTRACT

An electrical switch is provided with means movable in response to heat supplied thereto between circuit controlling positions, and the movable means has a predetermined generally arcuate configuration in one of its circuit controlling positions. Means for heating the movable means is predeterminately provided with a configuration generally corresponding to that of the movable means in its one circuit controlling position, and the heating means is disposed closely adjacent the movable means in its one circuit controlling position.

A method of calibrating a bimetal strip is also disclosed.

27 Claims, 9 Drawing Figures

ELECTRICAL SWITCH AND METHOD OF CALIBRATING

BACKGROUND OF THE INVENTION

This invention relates generally to electrical controls and in particular to an electrical switch and a method of calibrating a bimetal strip.

In the past, various types of electric switches have been utilized as starting relays for various types of electric motors, such as for instance those known as permanent split capacitor types. Generally, these permanent split capacitor type motors have characteristics affording relatively high torque at normal running speeds and lower power consumption, but with the capacitor connected in the motor circuit, generally relatively poor starting torque is encountered. In the event of a locked rotor condition, as may be encountered in some motor applications or usages, rather high current may be drawn by the motor which may have a deleterious affect on the electric switch being utilized as a motor starting relay. This condition may, of course, be considered as a disadvantageous or undesirable feature of at least some of the past electrical switches. Another one of the disadvantageous or undesirable features of at least some of these past electrical switches is believed to be that they were not automatically calibrated or at least they did not lend themselves readily to calibration. Another disadvantageous or undesirable feature of some of the past electrical switches is believed to be that they did not lend themselves to effect immediate restarting of the motor after a line or power interruption.

SUMMARY OF THE INVENTION

Among the several objects of the present invention may be noted the provision of an electrical switch and a method of calibrating a bimetal strip which overcome the disadvantageous or undesirable features discussed hereinabove, as well as others, with respect to the prior art; the provision of such method which affords a more efficient heat transfer between the bimetal strip and means for heating it; the provision of such electrical switch and such method in which the bimetal strip and the heating means therefor have generally corresponding configurations or shapes; the provision of such electrical switch in which operation is effected relatively quickly to attain a low value running current for a dynamoelectric machine which may be associated therewith; the provision of such electrical switch in which temperature rise is predeterminately limited; and the provision of such electrical switch and such method which are simplistic in design, economical for manufacture, and easily assembled or manufactured. These as well as other objects and features of the present invention will be in part apparent and in part pointed out hereinafter.

In general, an electrical switch in one form of the invention has supporting means, and movable means on the supporting means and operable generally in response to heat supplied thereto between a pair of circuit controlling positions. The and movable means is adapted to deflect upon subjection to a selected calibrating temperature toward a generally free predetermined configuration on the supporting means in one of the circuit controlling positions. Means is subjected to the selected calibrating temperature for fixedly assembling a portion of the movable means to the supporting means when the movable means is deflected toward its generally free predetermined configuration. Means is disposed on the supporting means for heating means to effect operation between the its circuit controlling positions upon energization of the electrical switch.

More particularly and also in general, an electrical switch in one form of the invention has a base of dielectric material with a pair of opposite ends. A pair of terminals are mounted by a pair of means to the base adjacent the opposite ends thereof, and a recess is formed at least in the base adjacent one of the opposite ends thereof. A bimetal strip has a pair of opposite end portions, and a flange integral with the bimetal strip generally constitutes one of the opposite end portions with at least a part of the flange being received in the recess. A thermal setting material is disposed in the recess securing the flange therein, and a movable contact is provided on the bimetal strip adjacent the other of the opposite end portions thereof. One of the means for mounting the terminals to the base includes means constituting a stationary contact for making and breaking engagement with the movable contact, and the bimetal strip has a predetermined generally arcuate configuration when its movable contact is in making engagement with the stationary contact. A resistance element is electrically connected between the terminals and disposed closely adjacent the bimetal strip for heating it, and the resistance element also has a predetermined generally arcuate configuration generally corresponding to that of the bimetal strip when its movable contact is in making engagement with the stationary contact. Means is provided for electrically connecting the bimetal strip adjacent the flange thereof with one of the terminals, and a cover is mounted to the base. Another stationary contact is provided on the cover generally opposite the first named stationary contact for making and breaking engagement with the movable contact, and the resiliency of the bimetal strip normally urges the movable contact into making engagement with the outer stationary contact. A third terminal is provided on the cover, and the cover has at least a metal portion for electrically connecting the third terminal and the other stationary contact.

Also in general, an electrical switch in one form of the invention thermally responsive means adapted to be movable in response to heat supplied thereto between a pair of circuit controlling positions. A single heating means is connected in circuit relation with the thermally responsive means in the electrical switch and adapted for energization to a certain or preselected heating condition for supplying heat to the thermally responsive means to effect movement thereof from one of the circuit controlling positions toward the other of the circuit controlling positions and to generally maintain the thermally responsive means in the other circuit controlling position so long as the heating means is energized to the certain or preselected heating condition thereof. Means is connected in circuit relation with the heating means and the thermally responsive means for defining a third circuit controlling position thereof, and the thermally responsive means is also movable in the event of the energization of the heating means to a more intense heating condition toward the third circuit controlling position connected across the heating means in shunt circuit relation therewith so as to interrupt the energization of the heating means.

Further in general, a method in one form of the invention is illustrated for calibrating a bimetal strip on means for supporting it. The supporting means has at least one electrical terminal and a contact respectively mounted thereto, and a recess is provided in at least one of the supporting means and the at least one electrical terminal. The bimetal strip has another contact thereon and a flanged portion spaced from the other contact. In this method, the bimetal strip is disposed generally in a free state on the supporting means with the other contact engaging the first named contact and the flange portion within the recess, and a hardenable material adapted to harden upon subjection to a selected temperature is placed in the recess. Thereafter, the bimetal strip and the hardenable material are subjected to the selected temperature to effect deflection of the bimetal strip toward a predetermined configuration so that the flange portion assumes a deflected position within the recess with the other contact engaging the first named contact, and the flange portion is secured in its deflected position within the recess by effecting the hardening of the hardenable material therein in response to the selected temperature.

Still further and in general, a method in one form of the invention is illustrated for calibrating a bimetal strip with respect to a means for mounting it. In this method, the bimetal strip is disposed in a generally free state on the mounting means. Then the bimetal strip is heated to at least a selected temperature so as to effect deflection of the bimetal strip from its generally free state toward a deflected configuration with respect to the mounting means, and a part of the bimetal strip is secured while it is in its deflected configuration to the mounting means.

Again in general, an electrical switch in one form of the invention has a pair of circuits adapted for energization. One of the circuits includes a contact and means for generating heat serially connected with the contact. The other of the circuits includes the contact, the heat generating means, another contact, and a thermally responsive switch blade movable between the first named contact and the other contact for making and breaking engagement therewith and serially connected with the heat generating means at a side thereof opposite the first named contact. The switch blade is initially movable in response to heat supplied thereto by the heat generating means upon energization of the circuits to break engagement from the other contact so as to interrupt the other circuit, and the switch blade also is further movable, in the event the supplied heat exceeds a predetermined value, into making engagement with the first named contact so as to be disposed in shunt circuit relation across the heat generating means interrupting its energization in the one circuit.

Still further in general, an electrical switch in one form of the invention has a housing with three terminals. A pair of contacts are connected with two of the terminals, and a thermally responsive switch blade is connected with the third one of the terminals and movable between making and breaking engagement with the contacts. Means for generating heat is mounted in the housing adjacent the switch blade and connected in series circuit relation with the switch blade between one of the two terminals and the third one of the terminals. The switch blade is movable in response to heat supplied thereto by the heat generating means upon energization of the electrical switch so as to break from one of the contacts interrupting the circuit therethrough between the two terminals, and the switch blade is also further movable, in the event the supplied heat exceeds a predetermined value, into making engagement with the other of the contacts so as to be connected between it and the third one of the terminals in shunt circuit relation about the heat generating means interrupting its energization.

BRIEF DESCRIPTION OF THE DRAWINGS

Corresponding reference characters indicate corresponding parts throughout the several views of the drawings.

Figure 1:
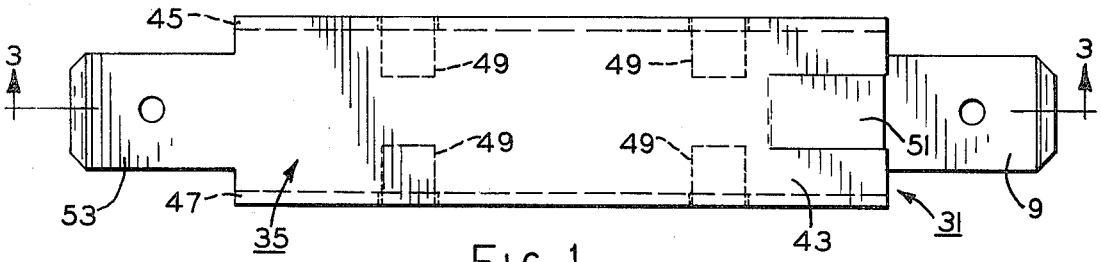
FIG. 1 is a plan view of an electrical switch in one form of the present invention.

The exemplifications set out herein illustrate the preferred embodiments of the invention and such are exemplifications presented merely for the purpose of disclosure and are not to be construed as limiting with respect to the invention in any manner.

DETAILED DESCRIPTION OF THE PREFERRED EMBODIMENTS

Referring now to the drawings in general, there is illustrated, in one form of the invention, a method for calibrating a bimetal strip 1 of a type well known in the art with respect to means, such as an elongate base or support 3 of a suitable dielectric material, for mounting or supporting the bimetal strip (FIGS. 4–8). In this calibrating method, deflection of bimetal strip 1 at a selected temperature is determined with respect to mounting means or base 3, and at least a part, such as an integral depending flange or flange portion 5, of the bimetal strip is secured to the base while the bimetal strip is in its deflected position.

Figure 4:
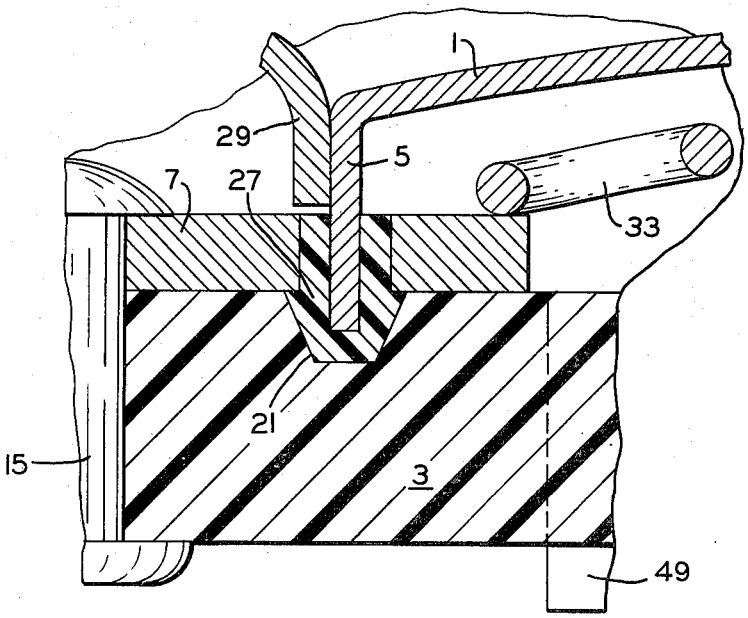
FIG. 4 is an enlarged fragmentary view taken from FIG. 3 showing the securement of the bimetal strip in the electrical switch.
Figure 5:
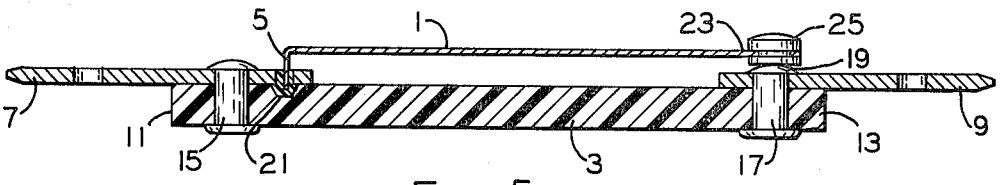
FIG. 5 is a sectional view illustrating the disposition of a bimetal strip with respect to a base portion of the electrical switch of FIG. 1 and teaching principles of a method of calibrating the bimetal strip of the electrical switch in one form of the invention.

More particularly and with specific reference to FIG. 5, a pair of terminals 7, 9 are disposed on base 3 adjacent to a pair of opposite ends 11, 13 thereof, and means, such as a pair of rivets 15, 17, is provided for connecting the terminals to the base. While one of the heads 19 of rivet 17 is illustrated as constituting a stationary contact, it is contemplated that a stationary contact separate from the rivet might be utilized within the scope of the invention. As shown in greater detail in FIGS. 2 and 4, recess means, such as an elongate recess or slot 21, is provided in base 3 extending through terminal 7, and the recess is disposed generally laterally of the base and terminal. Although recess 21 is shown in both base 3 and terminal 7, it is contemplated that the recess may be provided in only one of base 3 and terminal 7 within the scope of the invention. Bimetal strip 1 has a degree of inherent resiliency so that it may operate as a switch blade or spring arm, as is well known in the art, and in its relaxed or free state at room temperature, the bimetal strip is generally planar, as shown in FIG. 5. One of the pair of opposite end portions of bimetal strip 1 is generally constituted by its depending flange 5, and the other of the opposite end portions is constituted by a free or movable end 23 having a movable double contact 25 mounted thereon for making and breaking engagement with stationary contact 19.

Bimetal strip 1 is initially disposed or positioned on base 3 with flange 5 disposed in recess 21 and movable contact 25 engaged with stationary contact 19, as shown in FIGS. 4 and 5. Recess 21 and stationary contact 19 constitute a pair of means for generally locating bimetal strip 1 on base 3. However, upon deflection of bimetal strip 1, as discussed in greater detail hereinafter, bimetal strip flange 5 may be slightly moved or displaced from its relaxed or at-rest position within recess 21, and movable contact 25 may be slightly moved or displaced on stationary contact 19. In either event, it may be noted that bimetal strip flange 5 remains generally located within recess 21, and movable contact 25 remains generally located on or in locating engagement with stationary contact 19. A hardenable material, such as, in one form of the invention, an epoxy resin or other suitable thermal-setting plastic or bonding material 27, is placed or disposed in recess 21 for bonding, securing or fixedly assembling or connecting bimetal strip flange 5 therein against displacement. It is contemplated that material 27 may be placed in recess 21 either before or after bimetal strip flange is inserted thereinto.

Figure 6:
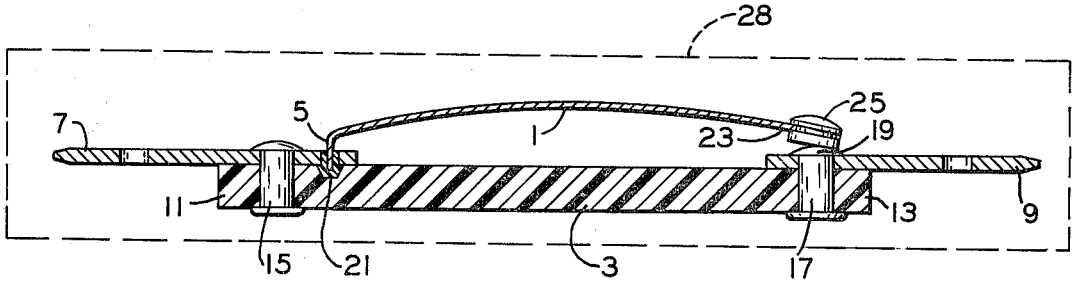
FIG. 6 is a sectional view showing the bimetal strip and base portion of the electrical switch of FIG. 5 positioned in an oven (designated in phantom lines) and illustrating a further step of the calibrating method.

When so assembled, bimetal strip 1 and base 3 may be placed into any suitable means, such as an oven 28 or the like indicated by the phantom lines in FIG. 6, for heating the bimetal strip to a selected calibrating temperature. This selected temperature is that which is necessary or which is desired for attaining full open position of the bimetal strip, as discussed hereinafter. As may be noted, when so heated, bimetal strip 1 deflects or assumes a predetermined curvature or generally arcuate configuration or shape as compared with its generally planar shape at room temperature (as seen in FIG. 5). When bimetal strip 1 attains its generally arcuate or predetermined configuration, flange 5 and movable contact 25 thereof are moved slightly with respect to recess 21 and stationary contact 19 on base 3 but remain generally located with respect thereto, as previously mentioned. Of course, material 27 will set or harden when subjected at least to the selected temperature not only to form a bond between bimetal strip flange 5 and the walls of recess 21 but also to maintain the bimetal strip flange in the deflected position it assumed within the recess when bimetal strip 1 attained its generally arcuate configuration.

Figure 7:
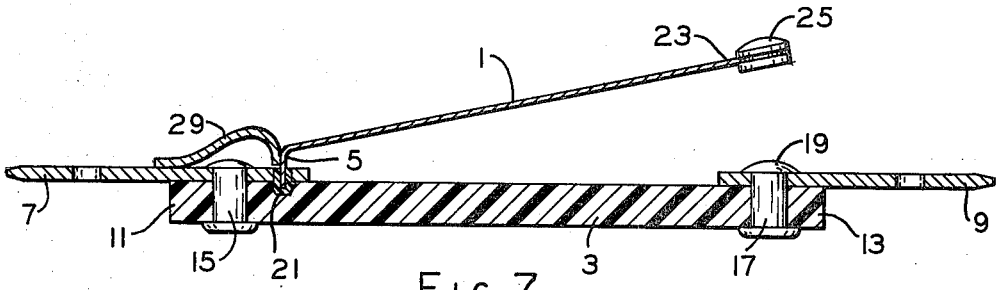
FIG. 7 is a sectional view showing the bimetal strip assembled to the base portion of the electrical switch upon the cooling thereof subsequent to removal from the oven of FIG. 6.

In this manner, the permanent disposition of bimetal strip flange 5 within recess 21 determines the stroke or travel of bimetal strip 1. The full stroke or travel may be the movement of bimetal strip 1 between its position when subjected to the selected temperature, i.e., with movable contact 25 in making engagement with stationary contact 19, and its relaxed or at-rest position when cooled to room temperature, as shown in FIG. 7. At this time, an electrical lead or connection, such as a pig tail 29 or the like, may be connected between terminal 7 and bimetal strip 1 generally adjacent flange 5 thereof by suitable means well known to the art, such as soldering for instance. In view of the foregoing, it may be noted that bimetal strip 1 is now calibrated to attain a predetermined deflection or generally arcuate configuration at the selected temperature, and when subsequently heated to such selected temperature, the bimetal strip will travel to engage movable contact 25 with stationary contact 19.

Figure 2:
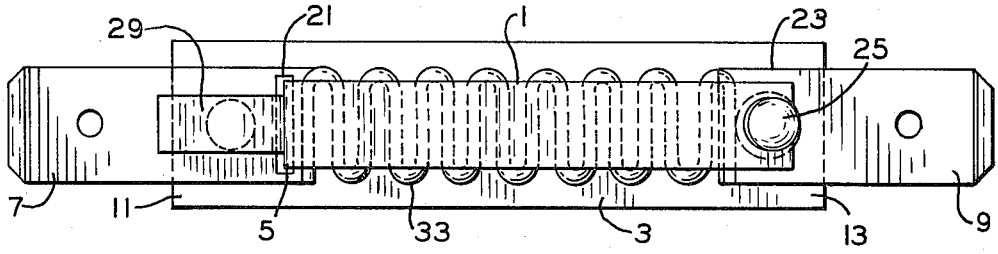
FIG. 2 shows the electrical switch of FIG. 1 with its top or cover removed.
Figure 8:
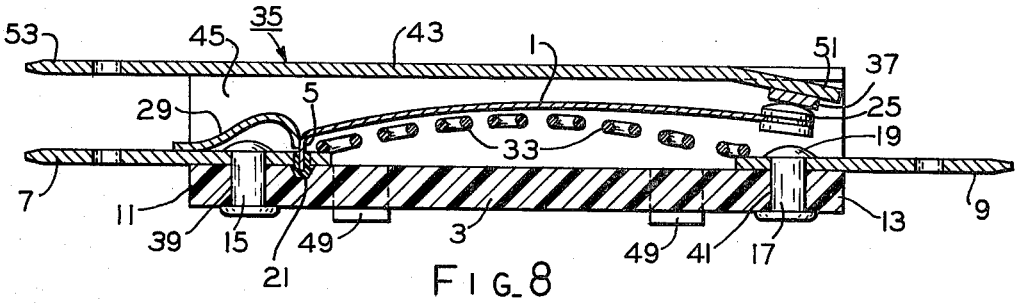
FIG. 8 is a sectioned view showing a completed electrical switch with a cover mounted to the base portion similar to that shown in FIG. 3 but with the bimetal strip in a normal (or cooled) one of its operable positions.

Referring now again to the drawings in general, another method is illustrated for making an electrical switch 31 having means, such as bimetal strip 1, adapted to be movable in response to heat supplied thereto between a pair of operable positions. In this making method, the curvature or generally arcuate configuration of movable means or bimetal strip 1 is determined in a selected one of the operable positions, i.e., with movable contact 25 in making engagement with stationary contact 19, as discussed hereinbefore with respect to the calibrating method for the bimetal strip. Means, such as an electrical resistance heater or serpentine-shaped resistance wire 33, for heating bimetal strip 1 is formed with generally the same curvature or generally arcuate shape as the bimetal strip in the one selected operable position thereof (FIGS. 2 and 8). Reistance heater 33 is then disposed in electrical switch 31 so that it is generally spaced closely adjacent bimetal strip 1 when it is in its one selected operable position.

More particularly, after the curvature of bimetal strip 1 has been determined by the calibrating method, as previously discussed, resistance heater 33 is bent or otherwise so formed to a generally arcuate configuration so as to have a curvature generally corresponding to that of the bimetal strip in its one selected operable position. It is also contemplated that the resistance heaters may be preformed within the scope of the invention. After resistance heater 33 is shaped, it is positioned closely adjacent bimetal strip 1 with the opposite ends of the resistance heater engaged with terminals 7, 9, and the opposite ends of the resistance heater may now be electrically connected by suitable means, such as soldering or the like for instance, to the terminals. It may be noted that providing generally the same arcuate configuration to bimetal strip 1 and resistance heater 33 assures good heat transfer therebetween and particularly when the bimetal strip is in its one selected operable position.

A cover or top 35 for electrical switch 31 may now be predeterminately positioned on base 3 so that another stationary contact 37 provided on the cover is oppositely disposed in predetermined spaced relation with respect to stationary contact as seen in FIG. 8. Base 3 and cover 35 generally constitute a housing for switch 31. Upon assembly of cover 35 with base 3, the engagement of stationary contact 37 with movable contact 23 bends or stresses bimetal strip 1 from its relaxed or at-rest position. This stressing of bimetal strip 1 serves to predetermine the temperature at which the bimetal strip will be actuated in response to heat supplied thereto by resistance heater 33 to break the engagement of movable contact 25 from stationary contact 37, as discussed hereinafter.

Referring now in general to FIGS. 1–4 and 8, electrical switch 31 in one form of the invention is provided with means, such as bimetal strip resilient switch blade 1, adapted to be movable in response to heat supplied thereto between a pair of circuit controlling positions, i.e., when movable contact 25 is in making and breaking engagement with stationary contact 37, respectively, as discussed hereinafter. Means, such as resistance heater 33 is energized in response to power applied thereto for heating bimetal strip or movable means 1 to effect movement thereof between the circuit controlling positions, and the bimetal strip is also movable to another operable position for shunting the heating means or resistance heater upon the occurrence of a certain condition.

Figure 3:
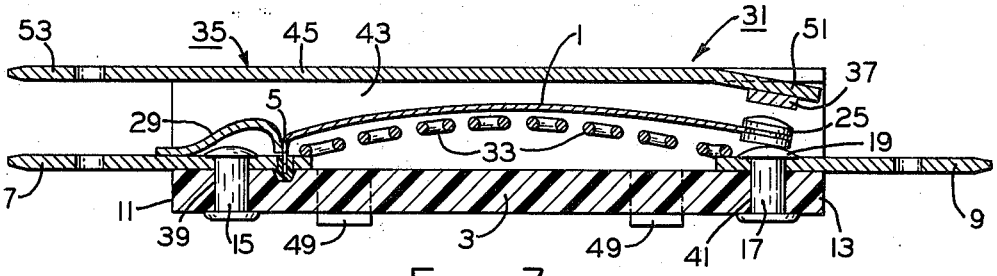
FIG. 3 is a sectional view taken along lines 3—3 of FIG. 1 with a bimetal strip of the electrical switch shown in a displaced (or heated) one of its operable positions.

More particularly, base 3 is provided with a pair of openings 39, 41 adjacent opposite ends 11, 13 of the base, and rivets 15, 17 are insert through the base openings into retaining engagement with terminals 7, 9, FIGS. 3 and 8. Of course, various fixturing (not shown) may be utilized to assemble base 3 and terminal 7, 9 with rivets 15, 17 for riveting over the heads thereof. It is contemplated that suitable means, other than rivets 15, 17, may be employed for securing terminals 7, 9 to base 3 at opposite ends 11, 13 thereof. After bimetal strip 1 has been secured to base 3, as discussed in detail above with respect to the calibrating method and the switch making method, cover 35 is removably secured to the base. Cover 35 is formed of metal having good electrical conduction properties and includes an elongate top 43 integrally interposed between a pair of depending side walls 45, 47. The free end of side walls 45, 47 rest upon or engage base 3 adjacent opposite marginal edges thereof, and means, such as a plurality of tabs 49, are spaced along the side wall free ends for displacement preventing engagement with the base. Tabs 49 are respectively bent or otherwise displaced into engagement with the base 3. The rightward end of cover top 43 (as seen in FIGS. 1 and 3) is lanced at 51, and the lanced part 51 is depressed so that stationary contact 37, which is carried on the lanced part, is predeterminately spaced from stationary contact 19 on base 3, as previously mentioned. The leftward end of cover top 43 constitutes another terminal 53 disposed in spaced apart overlaying relation with terminal 7 on base 3, and terminal 53 is, of course, electrically connected with stationary contact 37 through cover 35. It is contemplated that a cover may be provided of material other than metal with a metallic connection electrically interconnecting between terminal 53 and stationary contact 37 within the scope of the invention.

Figure 9:
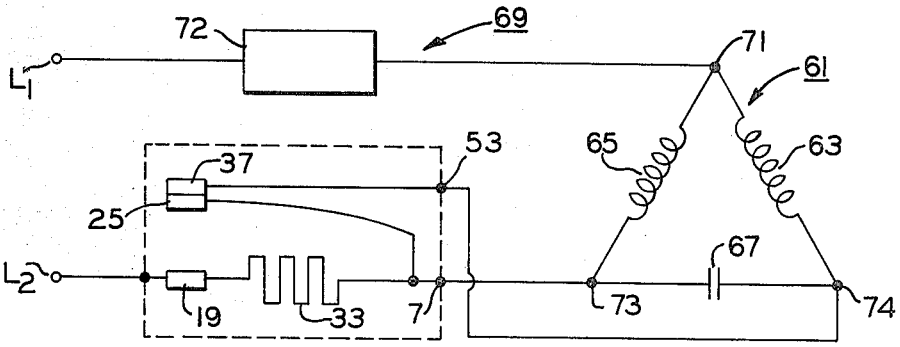
FIG. 9 is a schematic diagram showing a circuit for an electric motor with the electrical switch of FIG. 1 shown diagrammatically therein.

In FIG. 9, another method is illustrated for energizing a dynamoelectric machine, such as an electric motor illustrated schematically at 61, having a start winding 63 and a run winding 65 connected in parallel circuit relation and a capacitor 67 adapted to be selectively connected in series circuit relation with the start winding. In this method, means, such as bimetal strip 1 adapted to be thermally actuated, is biased into one circuit controlling position, i.e., in making engagement with stationary contact 37, for shunting capacitor 67 from circuit relation with start winding 63 wherein relatively high current is passed through both run winding 65 and the start winding during an initial or start-up period of motor energization. The relatively high current is utilized for heating thermally actuated means or bimetal strip 1 and effecting actuation thereof to another circuit controlling position, i.e., disengaged from stationary contact 37 for connecting capacitor 67 in series circuit relation with start winding 63 wherein motor 61 is thereafter energized at a normal running current. Means, such as resistance heater 33, for heating bimetal strip 1 is shunted from circuit relation with run winding 65 and the series connected capacitor 67 and start winding 63 in the event motor 61 draws current predeterminally in excess of the normal running current thereof.

There is also shown in FIG. 9 a circuit 69 for an electric motor 61. In this circuit, means, such as electrical switch 31, is provided for switching the circuit relation of capacitor 67 upon energization of heater 33. Switch 31 includes means, such as a resistance heater 33, in series circuit relation with both start winding 63 and run winding 65 during an initial period of motor energization for generating heat, and means, such as bimetal strip 1, is provided for shunting capacitor 67 from circuit relation with start winding 63 during the initial period of motor energization. Shunting means or bimetal strip 1 is operable generally in response to the generated heat to effect switching of capacitor 67 into series circuit relation with start winding 63 thereby to terminate the initial period of motor energization and thereafter energize motor 61 at its normal running speed. Bimetal strip 1 is also operable generally in response to an increase in the generated heated in excess of a predetermined value for shunting heat generating or resistance heater 33 in the event of the occurrence of a high current condition passing through at least the run winding 65 and the resistance heater which may deleteriously affect it.

More particularly, a motor terminal 71 is connected with a line or power terminal L1, and a motor protector switch 72 of a type well known in the art may, if desired, be electrically interposed between the motor terminal and the line terminal. Another motor terminal 73 is connected with terminal 7 of electrical switch 31 which has its terminal 9 connected with another line or power terminal L2. To complete the description of circuit 69, the motor terminal 74 is connected with terminal 53 of electrical switch 31.

OPERATION

Assuming that bimetal strip 1 of electrical switch 31 is in its circuit controlling or operable position making movable contact 25 with stationary contact 37, it is apparent that capacitor 67 is shunted from circuit relation with either of start winding 63 or run winding 65 of motor 61 as shown in FIGS. 8 and 9. With capacitor 67 so shunted, a rather high current is drawn through both start winding 63 and run winding 65 when motor 61 is connected across the line, i.e., across line terminals L1, L2, by actuation of an on-off type motor starting switch (not shown) to effect the initial or start-up period of motor energization. The rather high starting current across start winding 63 flows therefrom to terminal 53 of electrical switch 31 through cover 35 to stationary contact 37. Since movable and stationary contacts 25, 37 are in making engagement, as mentioned above, the relatively high current flows therefrom through bimetal strip 1, pigtail 29, terminal 7, resistance heater 33 and terminal 9 to line terminal L2. At the same time, the rather high starting current across run winding 65 flows therefrom through terminal 7 of electrical switch 31, resistance heater 33 and terminal 9 to line terminal L2. As may be noted, the relatively high starting current across both start winding 63 and run winding 65 is applied to resistance heater 33 of switch 31. Therefore, resistance heater 33 is very quickly energized to generate a relatively large amount of heat. In this manner, the quick generation of a relatively large amount of heat commensurate with the relatively large starting current is supplied or transmitted directly to bimetal strip 1 due to the relatively close disposition or spacing of the resistance heater with the bimetal strip. Of course, bimetal strip 1 is thermally responsive or actuated, and when the generated heat attains a value great enough to cause the bimetal strip to overcome its prestressed or pretensioned biased for urging movable contact 25 into making engagement with stationary contact 37, the bimetal strip will be actuated to deflect or pivot generally about its flange 5 toward base 3 thereby breaking engagement of the movable contact with stationary contact 37. In this manner, the circuit from start winding 63 through bimetal strip 1 and resistance heater 33 of switch 31 is interrupted thereby to terminate the initial or start-up period of energization for motor 61. It may be noted that the initial period of motor energization for starting is relatively short. This is due to the relatively high starting current drawn by start and run windings 63, 65 and the application thereof to resistance heater 33 which effects rather quick energization thereof for generating heat great enough to cause movement of bimetal strip 1 at a high rate of speed for opening movable and stationary contacts 25, 37. Of course, when movable and stationary contacts 25, 37 are disengaged, bimetal strip 1 is disposed in its other circuit controlling or operable position.

As may be recalled, capacitor 67 has been shunted from circuit relation with both start and run windings 63, 65 due to making engagement of movable and stationary contacts 25, 37; however, upon breaking disengagement of the movable contact from stationary contact 37, capacitor 67 is now placed in series circuit relation with start winding 63 and in parallel circuit relation with run winding 65. By placing capacitor 67 in this circuit arrangement with start and run windings 63, 65, the current drawn by motor 61 is reduced to a normal running value, and the motor will now operate at its normal running speed since the initial or start-up period is terminated, as discussed above.

With motor 61 now energized to run at its normal speed, the reduced amount of current drawn by the motor is applied to electrical switch 31 through a circuit thereof generally constituted by terminals 7, 9 and resistance heater 33 to line terminal L2. Of course, the watts or heat generated by resistance heater 33 is reduced commensurate with the reduction of current drawn by motor 61 at its normal running speed. However, it may be noted that the deflection of bimetal strip 1 toward base 3 not only brings the bimetal strip into closer spaced relation with resistance heater 33 but also the predetermined curvature or corresponding generally arcuate shapes of the bimetal strip and resistance heater effects a more effective transmission of the heat generated by the resistance heater to the bimetal strip. It therefore follows that bimetal strip 1 in its other circuit controlling position may be generally unaffected by the reduction of heat generated by resistance heater 33 since the bimetal strip is now closer to the resistance heater and the curvature of the bimetal strip more generally approximates that of the resistance heater. In its other circuit controlling or operable position, bimetal strip 1 may be generally disposed so that its movable contact 25 is between stationary contacts 19, 37, i.e., disengaged from each. However, bimetal strip 1 may hunt between its other circuit controlling position disengaging movable contact 25 from both stationary contacts 19, 37 and another operable position engaging the movable contact with stationary contact 19. This hunting action of bimetal strip 1 is believed to not affect the performance of motor 61 energized at its normal running speed. If the watts or heat generated by resistance heater 33 is of a value great enough to effect deflection of bimetal strip 1 to its operable position making engagement of movable contact 25 with stationary contact 19, resistance heater 33 is then shunted from circuit relation. When resistance heater 33 is so shunted, current will take the path of least resistance flowing in a circuit through electrical switch 31 from terminal 7 through pigtail 29, bimetal strip 1, movable and stationary contacts 25, 19 in making engagement to terminal 9 and therefrom to line terminal L2. Of course, this hunting action of bimetal strip 1 may be effected by many different variables in circuit 69, the power circuit connected therewith, or in the apparatus driven by motor 61 to increase the current drawn thereby to a value in excess of the normal running current. The shunting of resistance heater 33 by bimetal 1 upon the making engagement of movable and stationary contacts 25, 19 protects the resistance heater from deleterious affects, such as fusing and burning out or the like, upon the aforementioned certain or emergency conditions occasioned by current having a value in excess of the normal running current drawn by motor 61. Of course, the increased current flowing through bimetal strip 1 may heat it to a value great enough to maintain it in its operable position making engagement of movable and stationary contacts 25, 19.

When the condition of the aforementioned high current draw by motor 61 is alleviated, bimetal strip 1 will cool slightly returning to its other circuit controlling position disengaging movable contact 25 from stationary contact 19 thereby to terminate shunting of resistance heater 33. In this manner, resistance heater 33 is once again placed in circuit relation between start and run winding 63, 65 of motor 61 and line terminal L2 to effect re-heating or re-energization of the resistance heater. The heat once again generated by resistance heater 33 acts on bimetal strip 1 which is responsive thereto to remain in its other circuit controlling position, i.e., its mid-position wherein movable contact 25 is disengaged from both stationary contacts 19, 37.

It may be noted that the shunting or shorting out of resistance heater 33 in the event of a high current condition when motor 61 is energized at its normal running speed, as discussed above, acts to limit the temperature rise of electrical switch 31. This temperature rise limiting feature of electrical switch 31 also assures fast closure or re-engagement of movable contact 25 with stationary contact 37 when motor 61 is taken off the line by operator actuation of the on-off switch (not shown) for breaking circuit 69 between line terminals L1, L2.

In view of the foregoing, it is now apparent that a novel electrical switch 31 and a novel method of calibrating a bimetal strip 1 are provided meeting the objects and advantages set out hereinbefore, as well as others. It is contemplated that changes may be made by those skilled in the art as to the precise connections, arrangements, shapes, details of the constructions, as well as the precise steps for practicing the method, set forth herein for purposes of illustration and disclosure without departing from the spirit of the invention and the scope thereof as set out by the claims which follow.

What I claim as new and desire to secure by letters patent of the United States of America is:

1. An electrical switch comprising supporting means, movable means on said supporting means and operable generally in response to heat supplied thereto between a pair of circuit controlling positions, said movable means being adapted to deflect upon subjection to a selected calibrating temperature toward a generally free predetermined configuration on said supporting means in one of the circuit controlling positions, means subjected to the selected calibrating temperature for fixedly assembling a portion of said movable means to said supporting means when said movable means is deflected toward its generally free predetermined configuration, and means disposed on said supporting means for heating said movable means to effect its operation between the circuit controlling positions upon energization of said electrical switch.

2. An electrical switch as set forth in claim 1 wherein said movable means comprises a bimetal strip.

3. An electrical switch as set forth in claim 1 wherein said heating means comprises a power resistance element.

4. An electrical switch as set forth in claim 1 wherein said assembling means is generally constituted by a thermosetting material.

5. An electrical switch as set forth in claim 4 further comprising a recess in said supporting means, said thermosetting material and said portion being disposed in said recess.

6. An electrical switch comprising thermally responsive means adapted to be movable in response to heat supplied thereto between a pair of circuit controlling positions, a single heating means connected in circuit relation with said thermally responsive means in said electrical switch and adapted for energization to a preselected heating condition for supplying heat to said thermally responsive means to effect movement thereof from one of the circuit controlling positions toward the other of the circuit controlling positions and to generally maintain said thermally responsive means in the other circuit controlling position so long as said heating means is energized to the preselected heating condition thereof, and means connected in circuit relation with said heating means and said thermally responsive means for defining a third circuit controlling position thereof, said thermally responsive means also being movable in the event of the energization of said heating means to a more intense heating condition toward the third circuit controlling position connected across said heating means in shunt circuit relation therewith so as to interrupt the energization of said heating means.

7. An electrical switch as set forth in claim 6 further comprising a pair of stationary contacts for engagement with said thermally responsive means and respectively constituting the one circuit controlling position and the third circuit controlling position.

8. An electrical switch as set forth in claim 7 wherein said thermally responsive means is movable into the other circuit controlling position upon the disengagement of said thermally responsive means from one of the stationary contacts.

9. An electrical switch as set forth in claim 7 wherein said thermally responsive means includes a movable contact for making and breaking engagement with said stationary contacts.

10. An electrical switch as set forth in claim 6 wherein said thermally responsive means comprises a bimetal strip.

11. An electrical switch as set forth in claim 6 wherein said thermally responsive means is deflected into a predetermined configuration when it is in the third circuit controlling position, and means for mounting said heating means closely adjacent said thermally responsive means in said electrical switch, said heating means also having a predetermined configuration generally corresponding to that of said thermally responsive means in the third circuit controlling position thereof.

12. An electrical switch comprising a base of dielectric material and having a pair of opposite ends, a pair of terminals, a pair of means for mounting the terminals to the base adjacent the opposite ends thereof, respectively, a recess at least in the base adjacent one of the opposite ends thereof, a bimetal strip having a pair of opposite end portions, a flange integral with the bimetal strip and generally constituted by one of the opposite end portions with at least a part of the flange being received in the recess, a thermal setting material disposed in the recess for securing the flange therein, a movable contact on the bimetal strip adjacent the other of the opposite end portions thereof, one of said mounting means including means constituting a stationary contact for making and breaking engagement with the movable contact, the bimetal strip having a predetermined generally arcuate configuration when its movable contact is in making engagement with the stationary contact, a resistance element electrically connected with the terminals and disposed closely adjacent the bimetal strip for heating it, the resistance element also having a predetermined arcuate configuration generally corresponding to that of the bimetal strip when its movable contact is in making engagement with the stationary contact, means for electrically connecting the bimetal strip adjacent the flange thereof with one of the terminals, a cover mounted to the base, another stationary contact on the cover generally opposite the first named stationary contact for making and breaking engagement with the movable contact, the resiliency of the bimetal strip normally urging the movable contact into making engagement with the other stationary contact, a third terminal on the cover, and the cover at least having means for electrically connecting the third terminal and the other stationary contact.

13. A method of calibrating a bimetal strip with respect to a means for mounting it comprising the steps of:

a. disposing the bimetal strip in a generally free state on the mounting means; and b. heating the bimetal strip to at least a selected temperature so as to effect deflection of the bimetal strip from its generally free state toward a deflected configuration with respect to the mounting means and securing a part of the bimetal strip while it is in its deflected configuration to the mounting means.

14. The method as set forth in claim 13 wherein the heating and securing step comprises preheating to generally the at least selected temperature means for heating the bimetal strip and the mounting means and and placing the mounting means with the bimetal strip in its generally free state thereon so as to be subjected to the heating means.

15. The method as set forth in claim 13 wherein the disposing step comprises placing a pair of opposite end portions of the bimetal strip with respect to a pair of means predeterminately spaced on the mounting means for generally locating the opposite end portions, the bimetal strip part constituting one of the opposite end portions.

16. The method as set forth in claim 15 wherein the heating and securing step includes effecting movement of the opposite end portions to deflected positions with respect to the locating means when the bimetal strip is deflected toward its deflected configuration.

17. The method as set forth in claim 16 wherein the heating and securing step comprises connecting in fixed relation to the mounting means the one opposite end portion in its deflected position and located with respect to one of the locating means while the other of the opposite end portions is in its deflected position and located with respect to the other of the locating means.

18. The method as set forth in claim 13 comprising the preliminary step of disposing a hardenable material between the mounting means and the bimetal strip part, the hardenable material hardening when subjected to the at least selected temperature for effecting the securing of the bimetal strip part to the mounting means when the bimetal strip is deflected toward its deflected configuration.

19. The method as set forth in claim 18 wherein a recess is provided in the mounting means for receiving the bimetal strip portion and the hardenable material.

20. An electrical switch as set forth in claim 1 wherein said heating means comprises a power resistance element mounted on said supporting means adjacent said movable means and having a configuration generally corresponding to that of said movable means when it is deflected toward the one circuit controlling position.

21. An electrical switch as set forth in claim 1 further comprising at least one terminal means on said supporting means, and recess means in at least one of said supporting means and said at least one terminal means, said assembling means and said portion of said movable means being disposed in said recess means.

22. The method as set forth in claim 17, wherein the heating and securing step further comprises placing a hardenable material in communication between the mounting means and the one end portion, the hardenable material being adapted to harden when subjected to the at least selected temperature so as to effect the connecting in the fixed relation of the one opposite end portion in its deflected position to the mounting means.

23. A method of calibrating a bimetal strip on means for supporting it, the supporting means having at least one electrical terminal and a contact respectively mounted thereto, a recess in at least one of the supporting means and the at least one electrical material, the bimetal strip having another contact thereon and a flange portion spaced from the other contact, said method comprising the steps of:

a. disposing the bimetal strip generally in a free state on the supporting means with the other contact engaging the first named contact and the flange portion within the recess and placing in the recess a hardenable material adapted to harden upon subjection to a selected temperature; and b. subjecting the bimetal strip and the hardenable material to the selected temperature to effect deflection of the bimetal strip toward a predetermined configuration so that the flange portion assumes a deflected position within the recess with the other contact engaging the first named contact and securing the flange portion in its deflected position within the recess by effecting the hardening of the hardenable material therein in response to the selected temperature.

24. An electrical switch comprising supporting means including a stationary contact, at least one terminal means, and recess means in at least one of said supporting means and said at least one terminal means, movable means having another contact thereon and operable generally in response to heat supplied thereto for making and breaking said other contact with said stationary contact, an end portion on said movable means disposed within said recess means, said movable means being adapted for deflection upon subjection to a selected calibrating temperature toward a generally free predetermined configuration with respect to said supporting means wherein said other contact is made with said stationary contact and said end portion assumes a deflected position within said recess means, means disposed in said recess means and responsive to the selected calibrating temperature upon subjection thereto for fixedly mounting said end portion in its deflected position within said recess means, and means for heating said movable means to effect its operation making and breaking said other contact with said stationary contact upon energization of said electrical switch.

25. An electrical switch comprising a pair of circuits adapted for energization, one of said circuits including a contact, and means for generating heat serially connected with said contact, the other of said circuits including said contact, said heat generating means, another contact, and a thermally responsive switch blade movable between said first named contact and said other contact for making and breaking engagement therewith and serially connected with said heat generating means at a side thereof opposite said first named contact, said switch blade being initially movable in response to heat supplied thereto by said heat generating means upon energization of said circuits to break engagement from said other contact so as to interrupt said other circuit and said switch blade also being further movable in the event the supplied heat exceeds a predetermined value into making engagement with said first named contact so as to be disposed in shunt circuit relation across said heat generating means interrupting its energization in said one circuit.

26. An electrical switch comprising a housing having three terminals, a pair of contacts connected with two of said terminals, a thermally responsive switch blade connected with the third one of said terminals and movable between making and breaking engagement with said contacts, and means for generating heat mounted in said housing adjacent said switch blade and connected in series circuit relation with said switch blade between one of said two terminals and said third one of said terminals, said switch blade being movable in response to heat supplied thereto by said heat generating means upon energization of said electrical switch so as to break from one of said contacts interrupting the circuit therethrough between said two terminals and said switch blade also being further movable in the event the supplied heat exceeds a predetermined value into making engagement with the other of said contacts so as to be connected between it and the third one of said terminals in shunt circuit relation about said heat generating means interrupting its energization.

27. An electrical switch comprising a housing having three electrical terminals, a pair of stationary contacts mounted in said housing and connected with two of said terminals, a recess in at least one of said housing and a third one of said terminals, a thermally actuated switch blade connected with said third one of said terminals and having a pair of opposite end portions, a movable contact on said switch blade adjacent one of said opposite end portions for making and breaking engagement with said stationary contacts and the other of said opposite end portions being disposed in said recess, said switch blade being adapted for deflection upon subjection to a selected calibrating temperature toward a generally free predetermined configuration wherein said movable contact is disposed in making engagement with one of said stationary contacts and said other end portion assumes a deflected position within said recess, means disposed in said recess and adapted to harden in response to the selected calibrating temperature when subjected thereto for fixedly mounting said other end portion in its deflected position within said recess, said switch blade urging said movable contact toward making engagement with the other of said stationary contacts generally at a temperature less than the selected calibrating temperature, and means for generating heat upon energization of said electrical switch mounted in said housing adjacent said switch blade and connected in series circuit relation with said switch blade between said third one of said terminals and one of said two terminals, said switch blade being acutated in response to heat supplied thereto by said heat generating means when said electrical switch is energized so as to break engagement of said movable contact from said one stationary contact interrupting the circuit through said switch blade between said two terminals and said switch blade also being thereafter further actuated in the event the supplied heat at least approaches the selected calibrating temperature to make engagement of said movable contact with said other stationary contact wherein said switch blade is connected between said one of said two terminals and said third one of said terminals in shunt circuit relation across said heat generating means so as to interrupt its energization.

* * * * *

UNITED STATES PATENT OFFICE

CERTIFICATE OF CORRECTION

PATENT NO. : 3,968,468

DATED : July 6, 1976

INVENTOR(S) : Edward O. Andersen

It is certified that error appears in the above-identified patent and that said Letters Patent are hereby corrected as shown below:

| | | |
|---|---|---|
| Col. 1, | line 62, | delete "and". |
| Col. 2, | line 3, | after "heating" insert --the movable--; |
| | line 4, | after "effect" insert --its--; |
| | line 4, | delete "its"; |
| | line 45, | after "invention" insert --has--. |
| Col. 4, | line 44, | after "invention" insert --,--; |
| | line 44, | delete "are". |
| Col. 5, | line 45, | after "exemplifications" insert --are--. |
| Col. 9, | line 38, | delete "has" and insert --had--. |
| Col. 10, | line 13, | delete "to not" and insert --not to--. |
| Col. 13, | line 6, | delete "and" (third occurrence); |
| | line 65, | delete "material" and insert --terminal--. |

Signed and Sealed this

Fourth Day of January 1977

[SEAL]

*Attest:*

RUTH C. MASON
*Attesting Officer*

C. MARSHALL DANN
*Commissioner of Patents and Trademarks*